US012765649B2

(12) United States Patent
McGrath

(10) Patent No.: US 12,765,649 B2
(45) Date of Patent: Oct. 20, 2026

(54) JEWELRY FOR BINDING AND SECURING GARMENT ARTICLES

(71) Applicant: Pilar Ainara McGrath, Sherman, CT (US)

(72) Inventor: Pilar Ainara McGrath, Sherman, CT (US)

(73) Assignee: Pilar McGrath, Sherman, CT (US)

( * ) Notice: Subject to any disclaimer, the term of this patent is extended or adjusted under 35 U.S.C. 154(b) by 0 days.

(21) Appl. No.: 19/183,974

(22) Filed: Apr. 21, 2025

(65) Prior Publication Data

US 2025/0325076 A1 Oct. 23, 2025

Related U.S. Application Data

(60) Provisional application No. 63/636,860, filed on Apr. 21, 2024.

(51) Int. Cl.
*A44C 15/00* (2006.01)
*A41F 19/00* (2006.01)

(52) U.S. Cl.
CPC ..... *A44C 15/003* (2013.01); *A41F 19/00* (2013.01); *A44C 15/005* (2013.01)

(58) Field of Classification Search
CPC ..... A41F 1/002; A41F 19/005; A41F 17/00; A41F 19/00; Y10T 24/32; A44C 15/003; A44C 15/005; A44C 25/001; A44C 15/0045; A44C 15/0055; A44C 25/00; A44D 2203/00; A41D 1/215
See application file for complete search history.

(56) References Cited

U.S. PATENT DOCUMENTS

| | | | | |
|---|---|---|---|---|
| 6,427,244 | B1 | 8/2002 | Speier et al. | |
| 6,681,405 | B2 | 1/2004 | Yachimec et al. | |
| 8,640,266 | B2 * | 2/2014 | Best | A41F 19/00 2/104 |
| 8,769,780 | B1 * | 7/2014 | Segel | A41F 1/002 24/301 |
| 9,968,142 | B2 | 5/2018 | Asodaria | |
| 10,080,390 | B2 | 9/2018 | LaHann | |

(Continued)

FOREIGN PATENT DOCUMENTS

| | | | | |
|---|---|---|---|---|
| GB | 2501269 A | | 10/2013 | |
| GB | 2499248 B | | 4/2014 | |
| JP | 2014204833 A | * | 10/2014 | A44C 15/005 |

*Primary Examiner* — Jack W Lavinder
(74) *Attorney, Agent, or Firm* — Emanus, LLC; Willie Jacques

(57) ABSTRACT

A jewelry for binding and securing garment articles is disclosed. The jewelry comprises a back plate that further comprises a pinion lock monolithically attached over a first surface portion of the back plate; a spring reel encased within the back plate and detachably affixed to the pinion lock, the spring reel comprises a string coiled around an outer periphery of the spring reel; and a spring within an inner periphery of the spring reel. Further, a back plate cap encased within the back plate to secure the spring reel, the back plate cap comprises a first set of attachment units. Further, a front plate attached at one end of the string, the front plate comprises a second set of attachment units. The front plate is configured to engage with the back plate cap via the first set of attachment units and the second set of attachment units.

20 Claims, 25 Drawing Sheets

(56) References Cited

U.S. PATENT DOCUMENTS

| | | | | |
|---|---|---|---|---|
| 2005/0050918 | A1* | 3/2005 | Saintil-van Goodman | A44C 25/001 63/3.2 |
| 2009/0044920 | A1* | 2/2009 | De Angelis | A47H 19/00 160/349.2 |
| 2018/0064193 | A1* | 3/2018 | Curtis | A41F 1/002 |
| 2021/0274858 | A1 | 9/2021 | Garramone | |

* cited by examiner

JEWELRY FOR BINDING AND SECURING GARMENT ARTICLES

CROSS-REFERENCE TO RELATED APPLICATION

This application claims the priority benefit of provisional patent application Ser. No. 63/636,860, filed Apr. 21, 2024 by the present inventor, which is incorporated herein by reference in its entirety.

FIELD OF THE DISCLOSURE

The present invention relates in general to a multi-use garment securing device, and particularly to a jewelry for binding and securing garment articles fashioned as pendant jewelry with an interchangeable front plate.

BACKGROUND OF THE DISCLOSURE

Historically, mothers have found the experience of nursing an infant somewhat awkward and challenging, particularly when attempting to hold and secure an article of clothing—e.g., shirt, sweater, tank top, etc.—in place while nursing the infant, including in public or other situations. Other related challenges to nursing an infant include handling the infant and her breast simultaneously where one hand is used to nurse from one breast, whereas the other hand/arm are used to support her infant's body. With one hand she must shift her over garment (i.e., article of clothing) to expose her breast (i.e., the nipple area at minimal), while holding back her clothing from the nursing area so as not to impede the infant's access to the breast, distract her infant or limit her view of the suckling infant.

Numerous solutions have been presented in the prior art to facilitate breast feeding while also securing an article of clothing such as those shown in U.S. Pat. No. 8,640,266 to Elizabeth Best and U.S. Pat. No. 9,968,142 to Asodaria Rupal. However, none of these solutions easily solve the issue of preventing a garment from falling back down over the breast as the infant attempts to nurse while freeing up the mother's hand(s) for holding the child or other items, being inconspicuous, having selectable adjustability to accommodate different size garments, providing relief of the need to be separately carried, and also aiding the psychological well-being of the mother.

Hence, there remains a need for a garment securing device that prevents a garment from falling back down over the breast as the infant attempts to nurse; frees up the mother's hand(s) for holding the child or other items; is inconspicuous; has selectable adjustability to accommodate different size garments; need not be carried separately (no storage requirement); and aids the psychological well-being of the mother.

SUMMARY OF THE DISCLOSURE

In accordance with the present disclosure, a jewelry for binding and securing garment articles (i.e. a breast-feeding necklace) is configured for wearing by a user as an article of jewelry (e.g., pendant). The breast-feeding necklace (or necklace) is configured to assist a user (i.e., lactating women) in holding up a layer of clothing to allow breast-feeding without the clothing getting in the way. In an aspect, the article of clothing may be a shirt, sweater, tank top, etc. comprising the upper layer of clothing being worn. It is contemplated by the Inventor that the article of clothing, once held will allow easy access to the breast by an infant.

In one embodiment of the present disclosure, a jewelry for binding and securing garment articles is configured as a chain reel necklace including a magnetic pendant with chain attached thereto, removable from a magnetic base that when detached and extended with the chain may be wrapped around an article of clothing, and wherein the removable pendant with chain may be reattached to the base thereby securing the clothing in place. In an aspect, it is envisioned that the user will i) detach the removable magnetic pendant with attached chain from a magnetic pendant base, ii) place the upper layer of the clothing article between the pendant base and removable pendant and chain, and iii) then reattach the removable pendant to the base whereby the chain is wrapped around the article of clothing holding it in place.

In one embodiment, the necklace chain is connectably threaded through a hollow slot or channel forming a connection with a front plate cap via a locking clasp. In an aspect, the locking clasp is round (e.g., cylindrical) in shape. Further, the necklace chain is configured to wrap around a user's neck and, on a side, is threaded through a bail which is connected on the pendant back plate. Further, the back plate, including the pass-through hollow slot or channel configured thereon, allows the chain to be fed therethrough forming the necklace band. In addition, the locking clasp dispenses and/or retracts the chain to a desired length and secures the chain at this desired length. Even further, the front plate may be fashioned as jewelry and therein be configured to be interchangeable allowing different front plates to be used with the pendant.

In an alternative embodiment of the present disclosure, the jewelry for binding and securing garment articles is configured with the front plate and back plate operatively separated into integrated components comprising a front plate cap and a back plate cap, respectively. A string (e.g., nylon, high-strength string) connects a reel and pendant backplate to a front plate cap, itself attached to the pendant front plate. In an aspect, the front plate cap may be screwed onto the pendant front plate. Hence, the pendant front plate being operatively connected to the front plate cap allows the user to remove (unscrew) the pendant front plate thereby affording the user the ability to have interchangeable front plate designs for use as jewelry.

In an aspect, it is envisioned that the user will i) detach the removable pendant front plate including the front plate cap and attached string (pendant assembly) from the back plate cap, ii) place the upper layer of the clothing article between the pendant assembly, and iii) then reattach the removable pendant assembly to the back plate cap whereby the string is wrapped around the article of clothing holding it in place.

In another alternative embodiment of the present disclosure, the jewelry for binding and securing garment articles comprises a back plate comprising a pinion lock monolithically attached over a first surface portion of the back plate. Further, jewelry for binding and securing garment articles comprises a spring reel encased within the back plate and detachably affixed to the pinion lock. Further, the spring reel comprises a string coiled around an outer periphery of the spring reel and a spring coiled within an inner periphery of the spring reel. Further, the jewelry for binding and securing garment articles comprises a back plate cap encased within the back plate to secure the spring reel between the back plate and the back plate cap. The back plate cap comprises a first set of attachment units and a front plate detachably attached at one end of the string, the front plate comprising a second set of attachment units. The front plate is configured to detachably engage with the back plate cap via the first set of attachment units and the second set of attachment units.

In an aspect, an inner periphery of the back plate includes a first thread and an outer periphery of the back plate cap includes a second thread, such that the back plate cap is detachably secured to the back plate via a threaded engagement between the first thread and the second thread. Further, the first set of attachment units corresponds to at least positive magnets and the second set of attachment units corresponds to at least negative magnets configured to magnetically engage with the positive magnets. Further, an opposite end of the string is having a knot and the spring reel is having a first aperture. The knot is configured to pass through the first aperture to secure the opposite end of the string to the spring reel.

In an aspect, the back plate cap further comprises a second aperture. Further, the second aperture is configured to allow passing of the string through the back plate cap for attachment with the front plate. Further, the back plate further comprises a ring bail monolithically attached to a second surface portion of the back plate. The ring bail is configured to receive a chain for enabling a user to wear the breast-feeding necklace. Further, the spring reel comprises an extruded cut one end of the spring incudes a bend, the bend is affixed within the extruded cut to retain the spring in a loaded position within the spring reel. Further, the spring reel further comprises a cover, where the cover is positioned over the spring reel to secure the spring within the spring reel, the cover corresponds to a Teflon paper.

In an aspect, the front plate further comprises at least one cam lock and a slot, the at least one cam lock having a push button. Further, the one end of the string is interlocked within the slot and the push button is configured to release and detach the string from the front plate In an aspect of the present disclosure, a method for jewelry for binding and securing garment articles is disclosed. The method comprises detaching, via a user, a front plate of a breast-feeding necklace from a back plate cap. Further, the method comprises extending the front plate from underneath an article of the user to wrap the string around the article; and attaching the front plate to the back plate cap to lock the article in a position for executing one or more operations.

Other features and aspects of the disclosure will be apparent from the following description, list of elements, and the accompanying drawings.

BRIEF DESCRIPTION OF THE DRAWINGS

Various embodiments of the present disclosure can be more readily understood and appreciated from the following descriptions of various embodiments of the present disclosure when read in conjunction with the accompanying drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
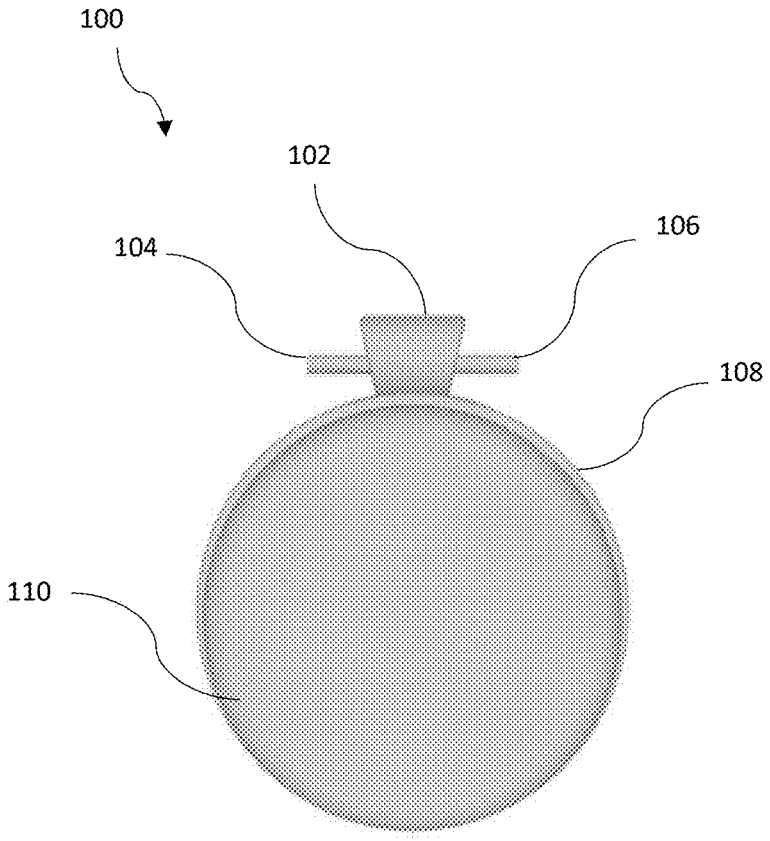
FIG. 1 is a front view showing an exemplary jewelry for binding and securing garment articles, according to an embodiment of the present disclosure.
Figure 2:
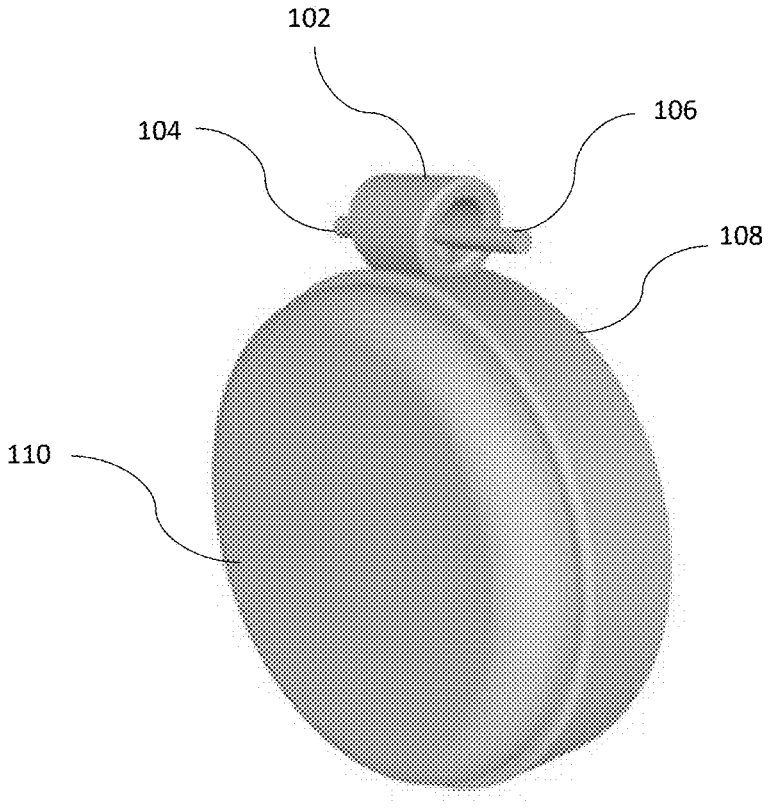
FIG. 2 is a perspective view of the jewelry of FIG. 1, according to an embodiment of the present disclosure.
Figure 3:
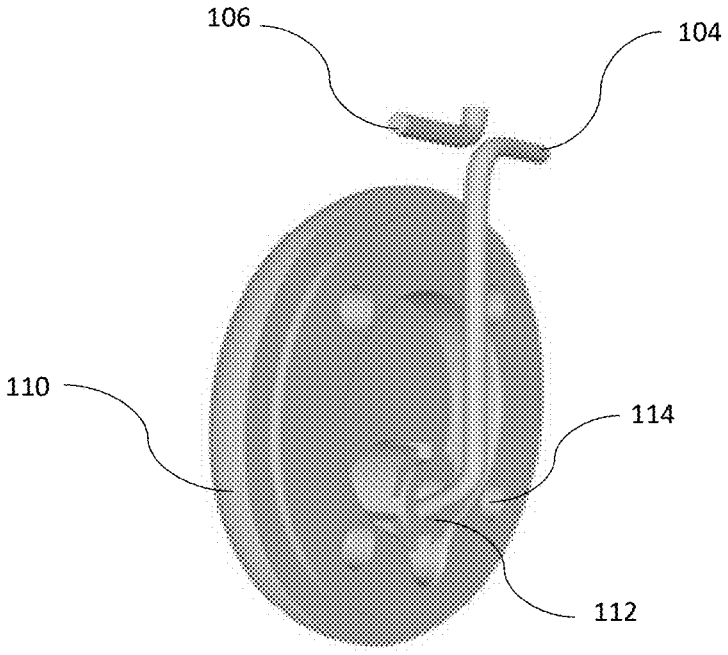
FIG. 3 is a perspective rear view of the front plate of the jewelry of FIG. 1 showing one side of the chain connected to the locking clasp, according to an embodiment of the present disclosure.
Figure 4:
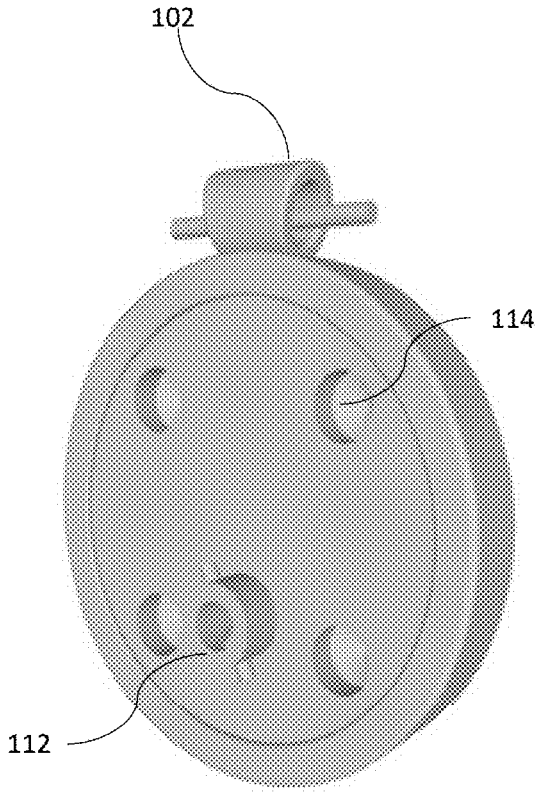
FIG. 4 is a perspective front view of the rear plate of the jewelry of FIG. 1 showing the locking clasp, pendant bail with chain therethrough, and magnet slots, according to an embodiment of the present disclosure.
Figure 5:
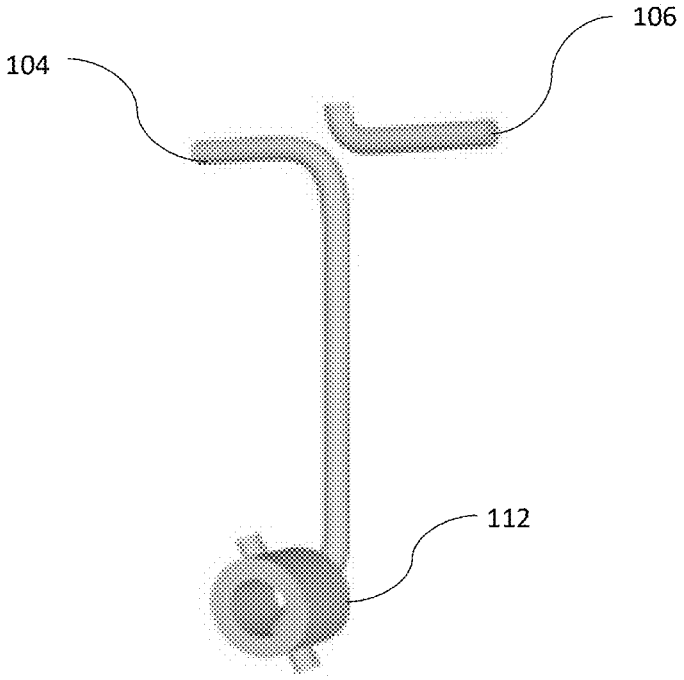
FIG. 5 is a perspective view of each side of the chain where one side of the chain is attached to the locking clasp.

FIGS. 1 and 2, separately or in combination illustrates a front view and front perspective view, respectively showing an exemplary jewelry for binding and securing garment articles 100 afterwords termed as breast-feeding necklace 100, according to an embodiment of the present disclosure. The breast-feeding necklace comprises a pendant bail 102 also termed as ring bail, necklace chain (one side, A) 104 also termed as chain, necklace chain (one side, B) 106, front plate 110, and back plate 108.

FIGS. 3 thru 6, separately or in combination illustrates various views showing an exemplary breast-feeding necklace 100, according to an embodiment of the present disclosure. These views of the breast-feeding necklace further comprises a locking round clasp 112 and magnet slots 114 also termed as a plurality of cavities, configured to seat magnets also termed as at least positive magnets and at least negative magnets, which hold the front plate and the back plate together.

Figure 6:
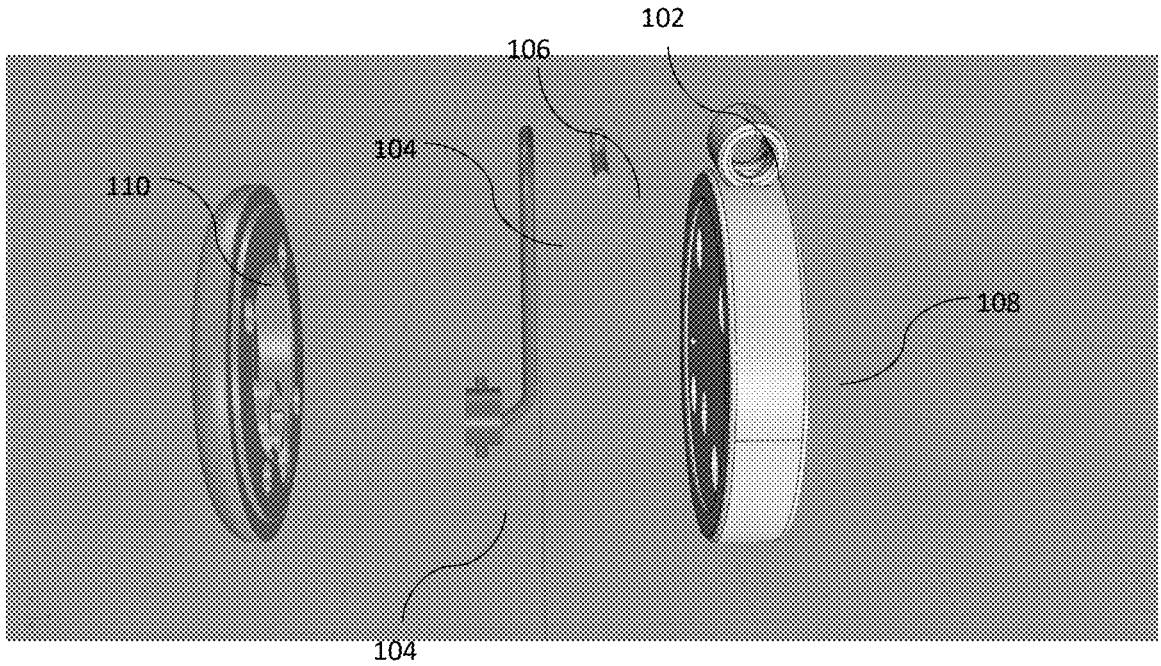
FIG. 6 is an exploded front perspective view of the jewelry of FIG. 1.
Figure 6A:
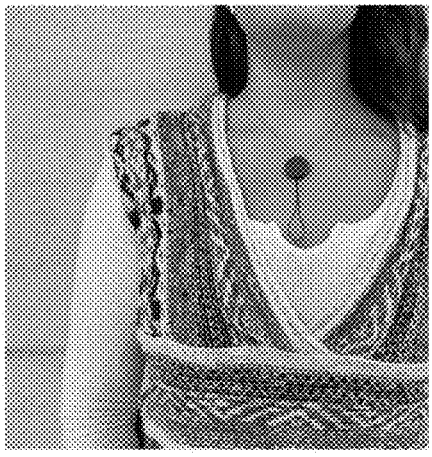
FIG. 6A is a picture of a user wearing the exemplary jewelry, where the necklace is shown resting on the user's body.
Figure 6B:
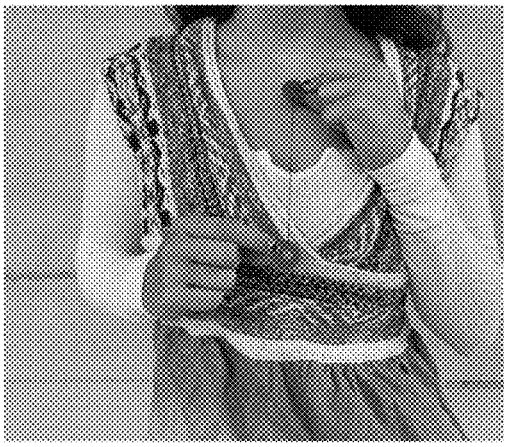
FIG. 6B is a picture of the user in FIG. 6A, where the user has detached the pendant front plate from the pendant back plate.
Figure 6C:
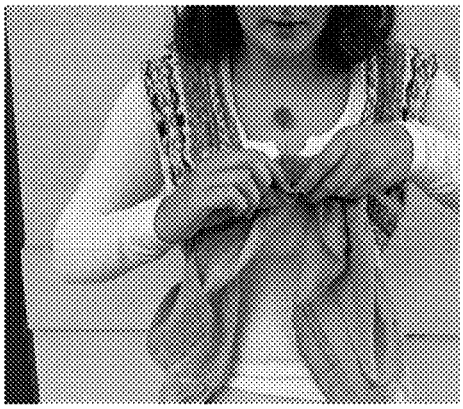
FIG. 6C is a picture of the user in FIG. 6A, showing the user placing an upper layer of clothing between the front and back pendant plates using the attached chain.
Figure 6D:
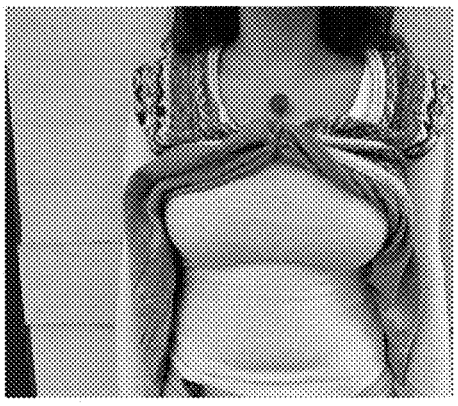
FIG. 6D is a picture of the user in FIG. 6A, where the user has reattached the front and back plates of the pendant thereby holding the article in a desired position.

FIGS. 6A thru 6D, illustrates the use of the breast-feeding necklace according to an embodiment of the present disclosure. In an exemplary method, a user as shown in FIG. 6A is shown wearing the breast-feeding necklace. The user, wanting to use the breast-feeding necklace first detaches the pendant front plate from the pendant back plate. Then the user places an upper layer of clothing between the front and back pendant plates using the attached chain. Next, the user reattaches the front and back plates of the pendant thereby holding the article in a desired position.

Figure 7:
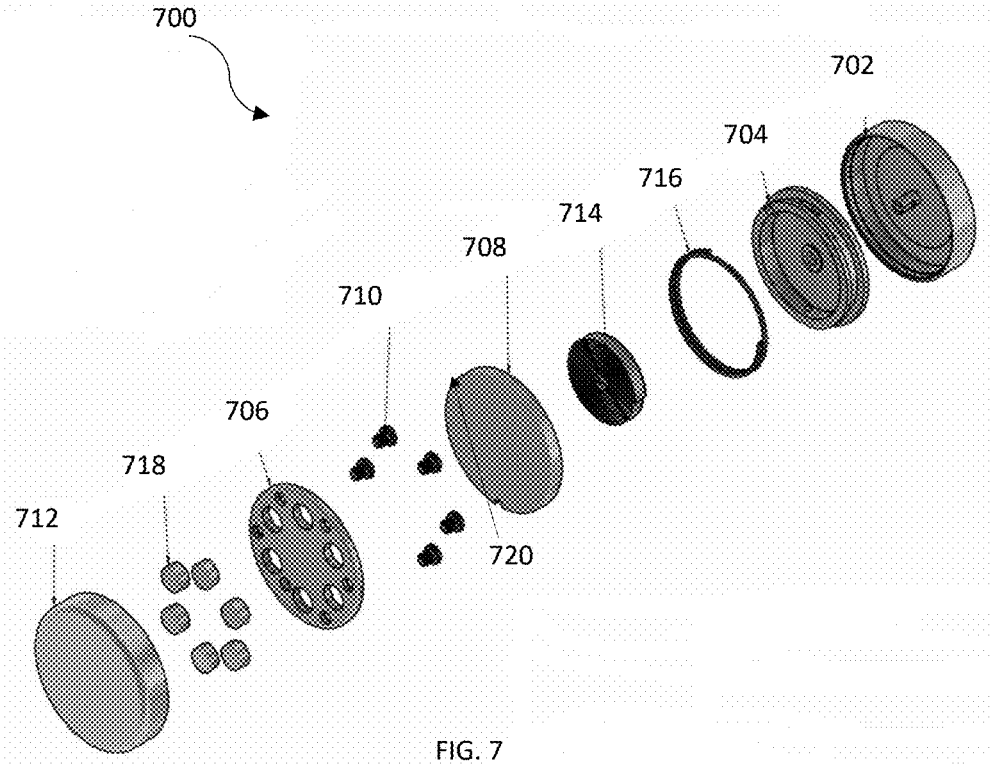
FIG. 7 is an exploded perspective view of the jewelry (sans bail and chain), according to an alternate embodiment of the present disclosure.
Figure 8:
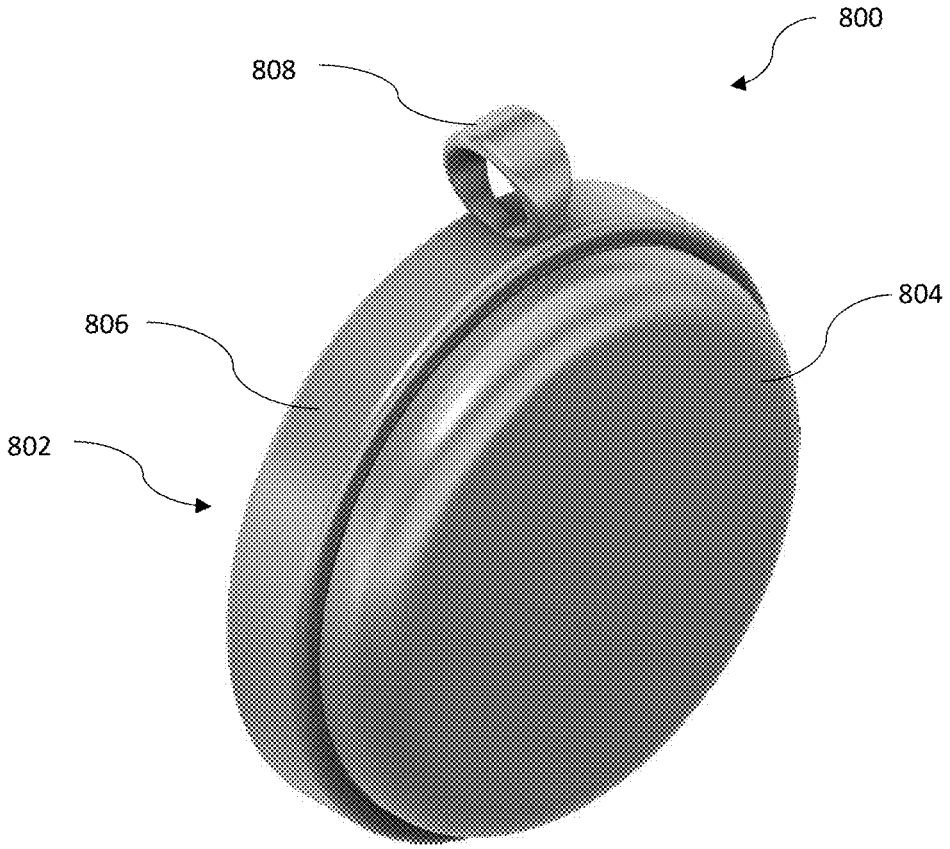
FIG. 8 illustrates an isometric view of a jewelry for binding and securing garment articles, according to another embodiment of the present disclosure.
Figure 14:
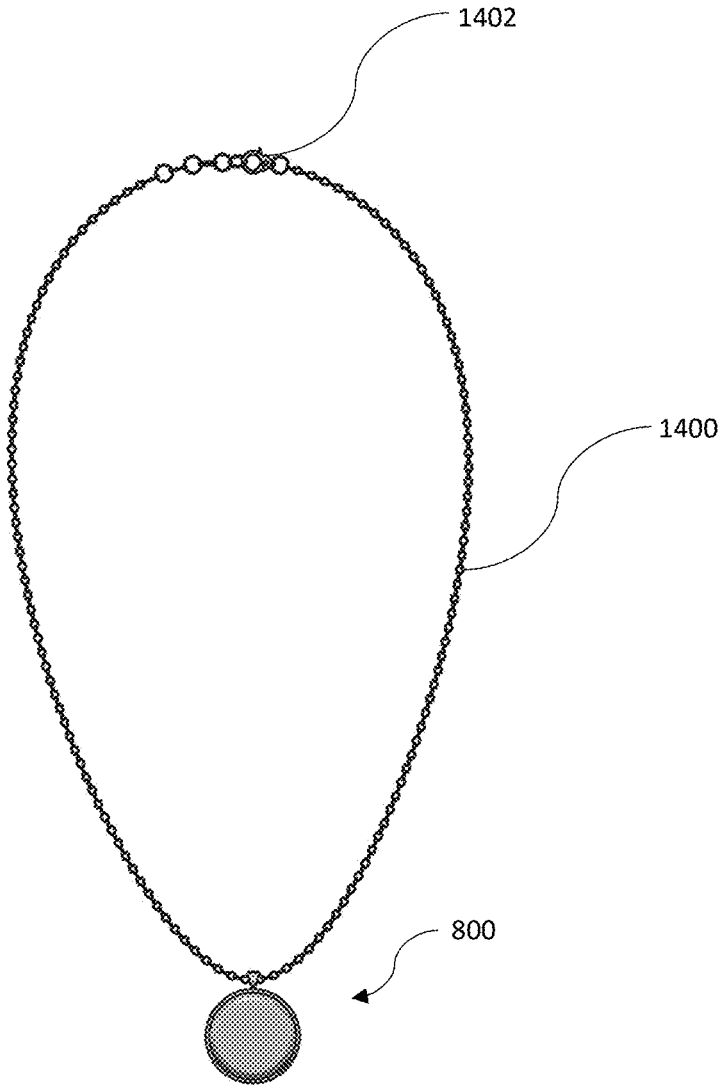
FIG. 14 illustrates the jewelry with a chain, according to another embodiment of the present disclosure.

In an alternative embodiment in accordance with FIG. 7, the breast-feeding necklace 700 includes a back plate 702, a reel 704 also termed as spring reel, a front plate cap 706, a back plate cap 708, screws (or other attachment means) 710, a pendant front plate 712 also termed as front plate, a coiled spring (or other tensioning means) 714 also termed as spring, a string 716, a magnet (or other attachable/detachable coupling means) 718, a slot/channel 720, and a bail and chain (shown in FIG. 8 and FIG. 14).

In an exemplary aspect, the pendant back plate 702 has seated within the reel 704. The reel 704 has the string 716 wrapped around its outer frame wherein one end of the string 716 is secured to the reel 704. Further, the other end of the string 716 is threaded through slot/channel 720 and secured to the front plate cap 706. It may be noted that the string 716 may be made of nylon or some other flexible, high strength material.

In another exemplary aspect, the back plate cap 708 encloses the spring 714, string 716, and reel 704, and is operatively attached, on one side, to the pendant back plate 702. The back plate cap 708 on its opposite side (generally flat, planar side) is configured to magnetically attach to the pendant front plate 712 via one or a plurality of magnets 718 configured in/through the holes of the front plate cap 706. The front plate cap 706 is also configured to allow screws 710 to be attached to the pendant front plate 712 via thru-holes machined (or otherwise configured) on the front plate cap 706. It is envisioned that a user may use screws 710 to remove and/or attach different pendant front plates 712, thereby allowing interchangeability of pendant faces.

In yet another exemplary aspect, FIGS. 6A thru 6D, generally illustrates the use of the breast-feeding necklace according to an embodiment of the present disclosure. (Note: In this description, breast-feeding necklace 700 is assumed to be used and includes a bail for threading therethrough a chain that goes around the user's neck.)

In an exemplary method, a user as shown in FIG. 6A is shown wearing a breast-feeding necklace. The user, wanting to use the breast-feeding necklace first detaches the pendant assembly from the pendant back plate cap. Then the user places an upper layer of clothing between the pendant assembly and pendant back plate cap using the attached string (in this case). Next, the user reattaches the pendant assembly to the pendant back plate cap thereby holding the article in a desired position. For the sake of clarity, the pendant assembly comprises the pendant front plate 712, magnets 718, front plate cap 706, and screws 710.

Figure 9:
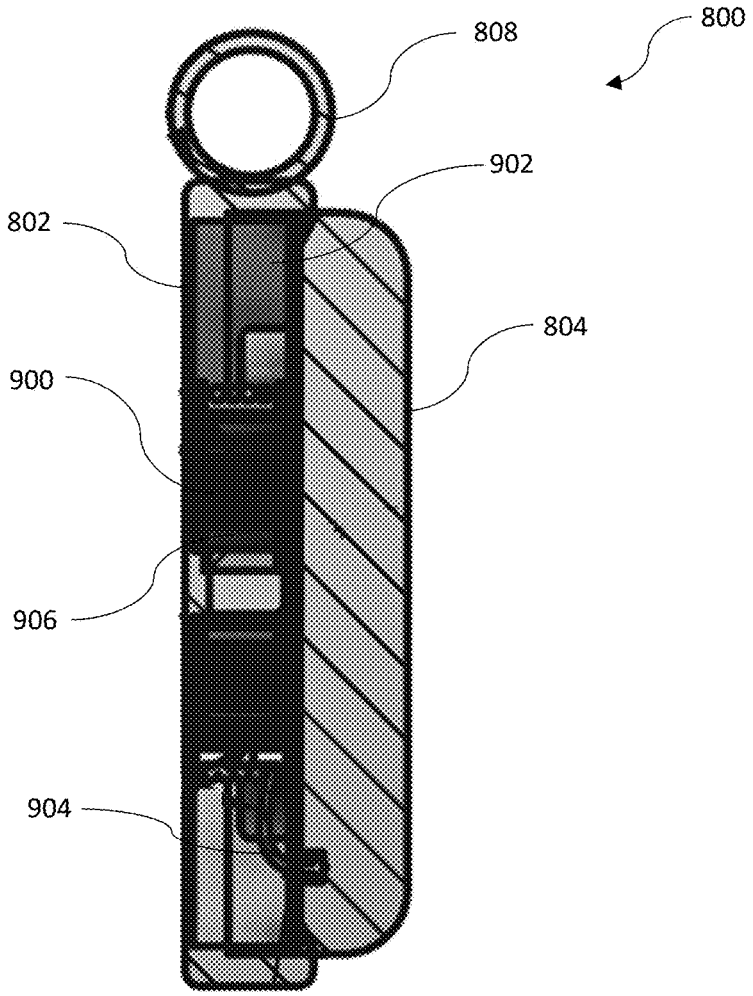
FIG. 9 illustrates a side sectional view of the jewelry, according to another embodiment of the present disclosure.
Figure 10:
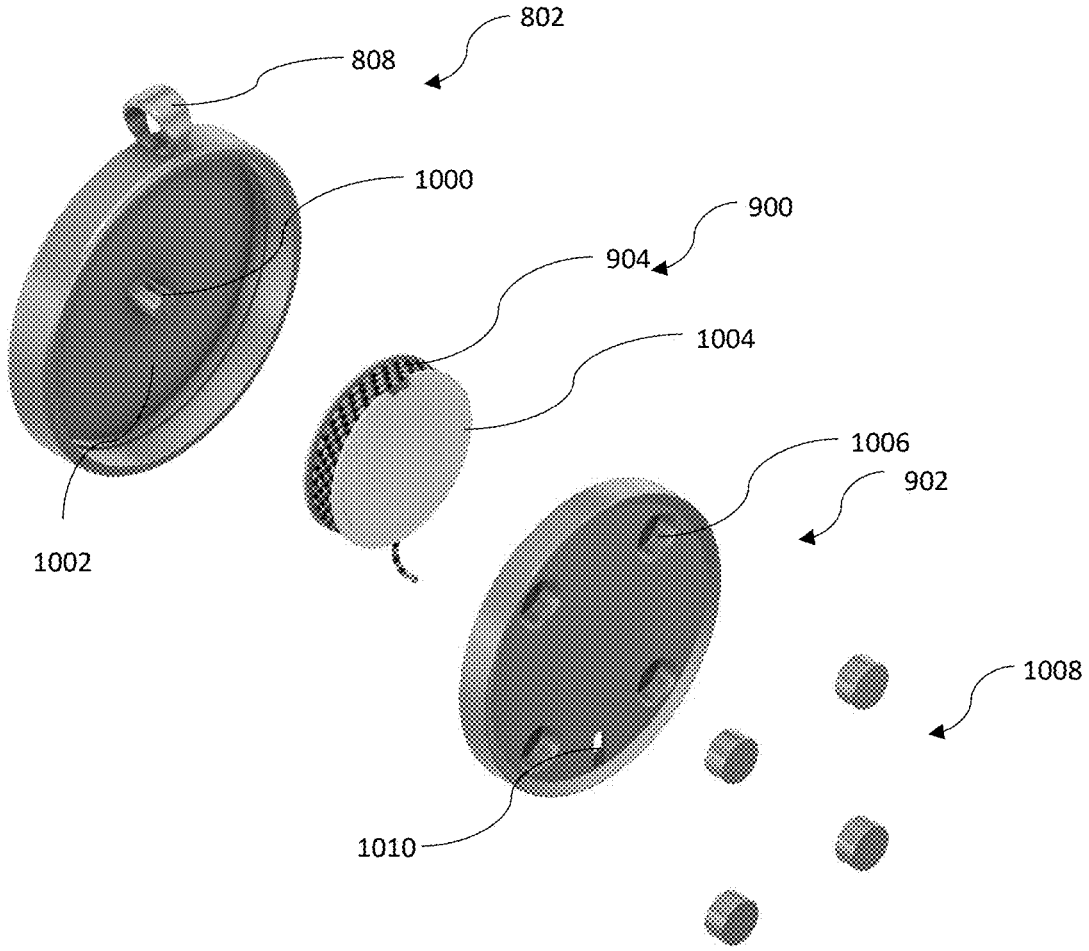
FIG. 10 illustrates an exploded view of the jewelry, according to another embodiment of the present disclosure.
Figure 11:
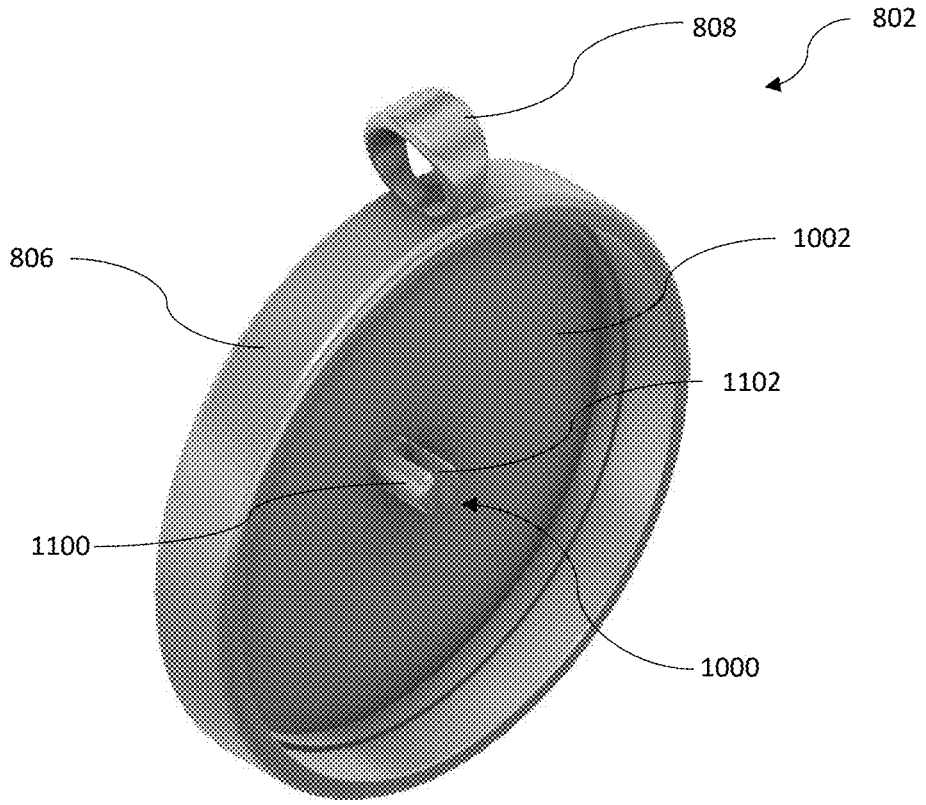
FIG. 11 illustrates an isometric view of a back plate, according to another embodiment of the present disclosure.

FIG. 8 illustrates an isometric view of a breast-feeding necklace 800, according to another embodiment of the present disclosure. FIG. 9 illustrates a side sectional view of the breast-feeding necklace 800, according to another embodiment of the present disclosure. FIG. 10 illustrates an exploded view of the breast-feeding necklace 800, according to another embodiment of the present disclosure. FIG. 11, illustrates an isometric view of a back plate 802, according to another embodiment of the present disclosure.

In some embodiments, a jewelry for binding and securing garment articles 800 also termed as the breast-feeding necklace 800 is configured for wearing by a user as an article of jewelry (e.g., pendant). The breast-feeding necklace 800 (or necklace) is configured to assist the user (i.e., lactating women) in holding up a layer of clothing to allow breast-feeding without the clothing getting in the way. In an aspect, the article of clothing may be a shirt, sweater, tank top, etc. comprising the upper layer of clothing being worn. It is contemplated by the Inventor that the article of clothing, once held will allow easy access to the breast by an infant improved posture, positioning and more visibility.

In some embodiments, the breast-feeding necklace 800 comprises the back plate 802 and a front plate 804. In some embodiments, one side of the back plate 802 may be positioned along the surface of the user's cloth or body and an opposite side of the back plate 802 may be covered with the front plate 804, as shown in the FIG. 8. The back plate 802 forms a foundational structure of the breast-feeding necklace 800. The back plate 802 is configured to house and support several internal components to form the breast-feeding necklace 800. In some embodiments, the back plate 802 may be a circular shaped body. It may be noted that the back plate 802 and the front plate 804 may be of varied shapes and sizes other than the circular shape. The back plate 802 may be fabricated from a durable material such as plastic, resin, polymer composite, or lightweight metal such as gold, silver, selected to ensure structural integrity while maintaining comfort for wearable use.

In some embodiments, the back plate 802 may further comprise a first surface portion (1002) and a second surface portion 806. In some embodiments, the first surface portion may correspond to an inner flat surface portion of the back plate that will be described in more detail in following paragraphs. Further, the second surface portion 806 may correspond to an outer periphery portion of the back plate 802. Further, the outer periphery portion may be perpendicularly extended around the inner flat surface portion of the back plate 802 forming a surrounding wall or a rim that defines a structural boundary of the back plate 802. In some embodiments, the back plate 802 further comprises a ring bail 808. In some embodiments, the ring bail 808 may be monolithically attached to the second surface portion 806 of the back plate 802. In some embodiments, the ring bail 808 may be configured to receive a chain for enabling the user to wear the breast-feeding necklace 800.

In some embodiments, the breast-feeding necklace 800 further comprises a spring reel 900, a back plate cap and the front plate 804, as shown in the FIGS. 9 and 10. In some embodiments, the spring reel 900 further comprises a string 904 and a spring 906 as shown in the FIGS. 9 and 10. It may be noted that the spring reel 900 having a cover 1004, the back plate cap 902 comprising a plurality of cavities 1006 having a first set of attachment units 1008, a second aperture 1010 and the front plate 804 is described in more detail in the following figures.

In some embodiments, the back plate 802 comprises a pinion lock 1000, as shown in FIG. 10. The pinion lock 1000 may be monolithically attached over the first surface portion 1002 of the back plate 802. In some embodiments, the pinion lock 1000 may be monolithically attached over the first surface portion 1002 of the back plate 802 via one or more techniques. The one or more techniques may include at least one of spot welding, over molding, injection molding, integrated 3D printing etc. depending on material composition and manufacturing method employed. These one or more techniques enable the pinion lock 1000 to be integrally formed with the back plate 802, enhancing structural stability and minimizing assembly complexity.

In one embodiment, the pinion lock 1000 is integrally formed on the first surface portion 1002 of the back plate 802 and is configured to receive and retain the spring reel 900. The pinion lock 1000 comprises a pair of protruded sections 1100 (as shown in FIG. 11) that are symmetrically positioned to form two semicircular bars, collectively defining a generally circular or arcuate retention region. A narrow gap 1102 (as shown in FIG. 11) is formed between the pair of protruded sections 1100 at a centreline of the structure, enabling a flexible or snap-fit locking mechanism. The narrow gap 1102 allows for controlled deflection or compression during insertion or removal of the spring reel, thereby securing the spring reel 900 in place through frictional or interference engagement. The geometry of the pair of protruded sections 1100 provides both alignment and retention functionality, ensuring that the spring reel 900 remains stably positioned during an operation such as breast-feeding etc., while still being detachable for maintenance or replacement.

Figure 12A:
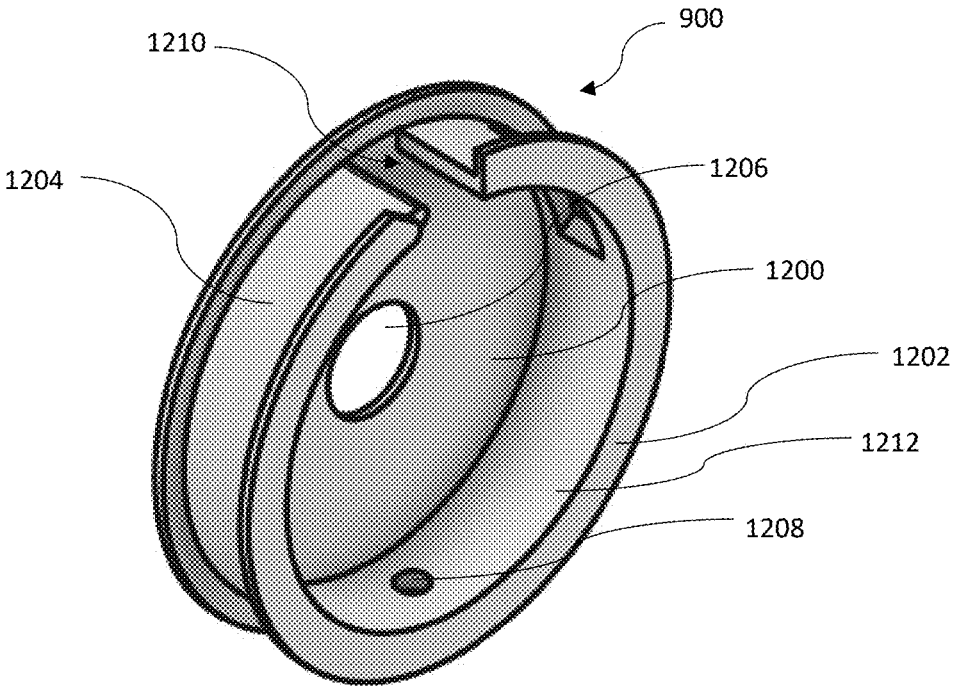
FIG. 12A illustrates an isometric view of the spring reel, according to another embodiment of the present disclosure.
Figure 12B:
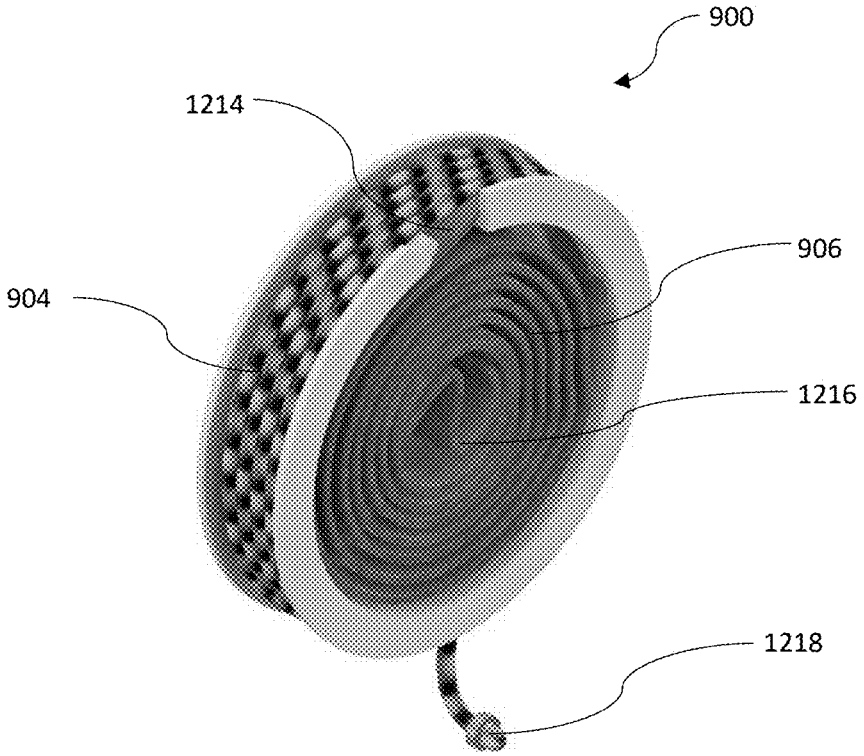
FIG. 12B illustrates another isometric view of the spring reel equipped with the string and the spring, according to another embodiment of the present disclosure.
Figure 12C:
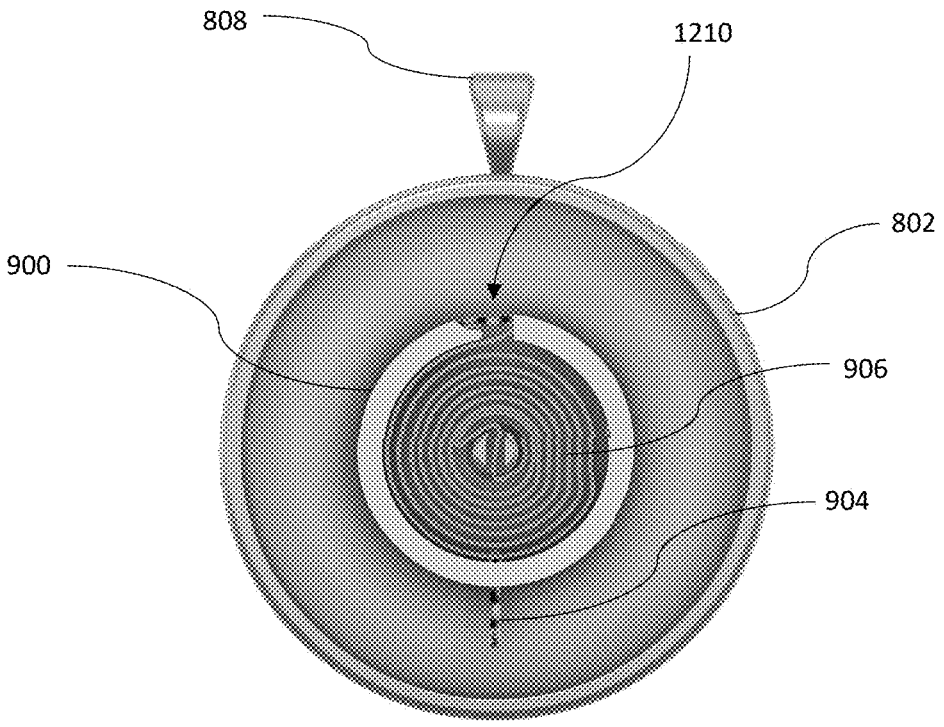
FIG. 12C illustrates the spring reel encased within the back plate, according to another embodiment of the present disclosure.

FIG. 12A, illustrates an isometric view of the spring reel 900, according to another embodiment of the present disclosure. FIG. 12B, illustrates another isometric view of the spring reel 900 equipped with the string 904 and the spring 906, according to another embodiment of the present disclosure. FIG. 12C, illustrates the spring reel 900 encased within the back plate 802, according to another embodiment of the present disclosure.

In some embodiments, the breast-feeding necklace 800 may further comprise the spring reel 900. The spring reel 900 may be encased within the back plate 802 and detachably affixed to the pinion lock 1000. In some embodiments, the spring reel 900 may be circular in shape. In some embodiments, the shape of the spring reel 900 may be based at least on the shape of the back plate 802. The shape of the back plate 802 mat not be limited to circular shape. Similar to the back plate 802, the bade reel 900 may also comprise a central flat portion 1200 which is surrounded by a perpendicularly extended portion 1202 along an outer periphery 1204 of the central flat portion 1200 of the spring reel 900 forming a surrounding wall or a rim.

Further, the spring reel 900 is fabricated with a hole 1206 on the central flat portion 1200 of the spring reel 900. In some embodiments, the hole 1206 is configured to allow passage of the pinion lock 1000 to enable interlocking of the spring reel 900 with the back plate 802. Further, the spring reel 900 comprises a first aperture 1208. In some embodiments, the first aperture 1208 may be fabricated at the perpendicularly extended portion 1202 along an inner periphery 1212 of the spring reel 900. In some embodiments, the first aperture 1208 may be configured to enable a knot of the string 904 to pass through the first aperture 1208 to secure the string 904 with the spring reel 900. Further, one end of the string 904 may be detachably attached to the front plate 804 that will be described in further embodiments.

In some embodiments, the string 904 may be coiled around the outer periphery 904 of the spring reel 900, as shown in the FIG. 12B. In some embodiments, the string 904 may be configured to stretched along a length from the spring reel 900. In some embodiments, the spring reel 900 may further comprise an extruded cut 1210. In some embodiments, one end of the spring 906 may include a bend 1214. In some embodiment, the bend 1214 is affixed within the extruded cut 1210 to retain the spring 906 in a loaded position within the spring reel 900. Further, other end of the spring 906 may include another bend 1216, as show in the FIG. 12B. In some embodiments, the bend 1214 may be configured to be attached to the hole 1206 as described earlier on the central flat portion 1200 of the spring reel 900.

Further, the one end of the string 904 may have a knot 1218. In some embodiments, the knot 1218 is configured to secure the one end of the string 904 to the spring reel 900. In some embodiments, the spring reel 900 further comprises the cover 1004 as shown in FIG. 10. In some embodiments, the cover 1004 (as shown in FIG. 10) may be positioned over the spring reel 900 to secure the spring 906 within the spring reel 900. In some embodiments, a Teflon grease may be added to the spring 906, and once the Teflon grease is added, the spring 906 is secured with the cover 1004. In some embodiments, the cover corresponds to a Teflon paper.

Figure 13A:
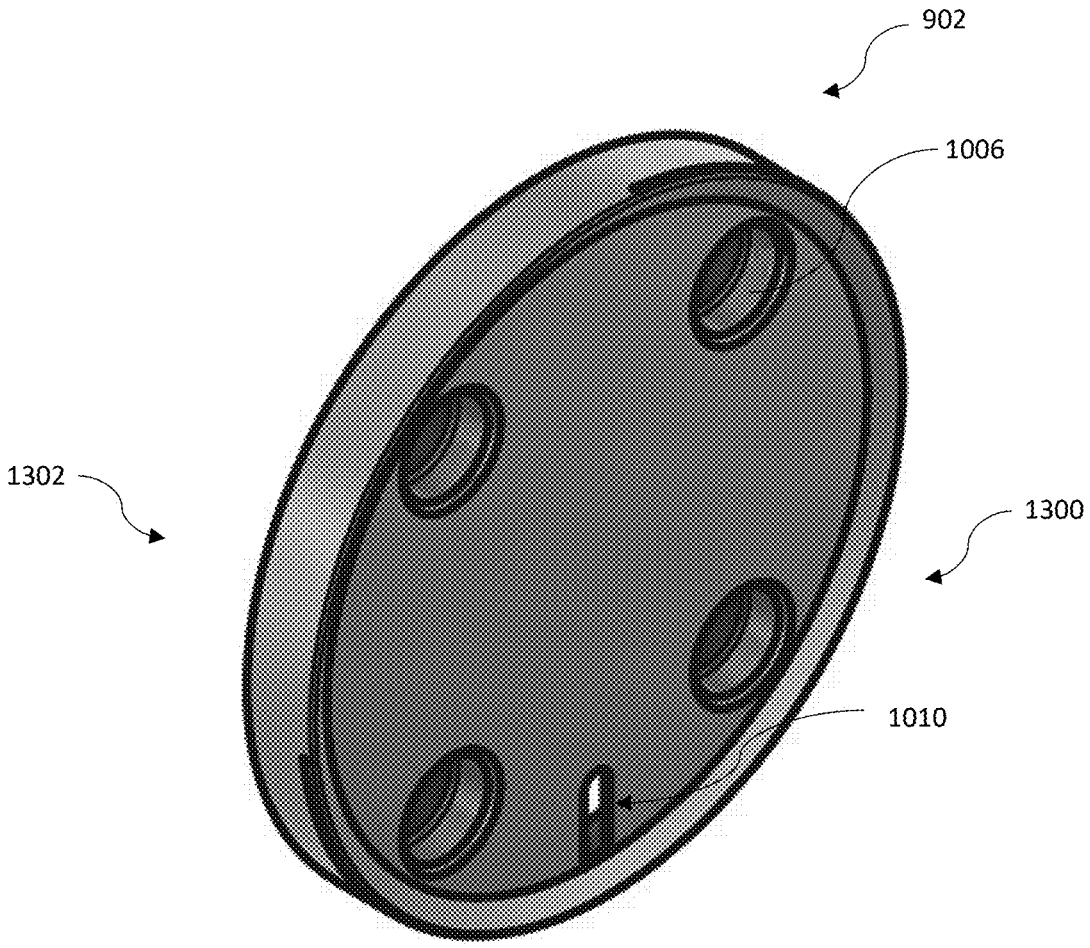
FIG. 13A illustrates an isometric view of the back plate cap, according to another embodiment of the present disclosure.
Figure 13B:
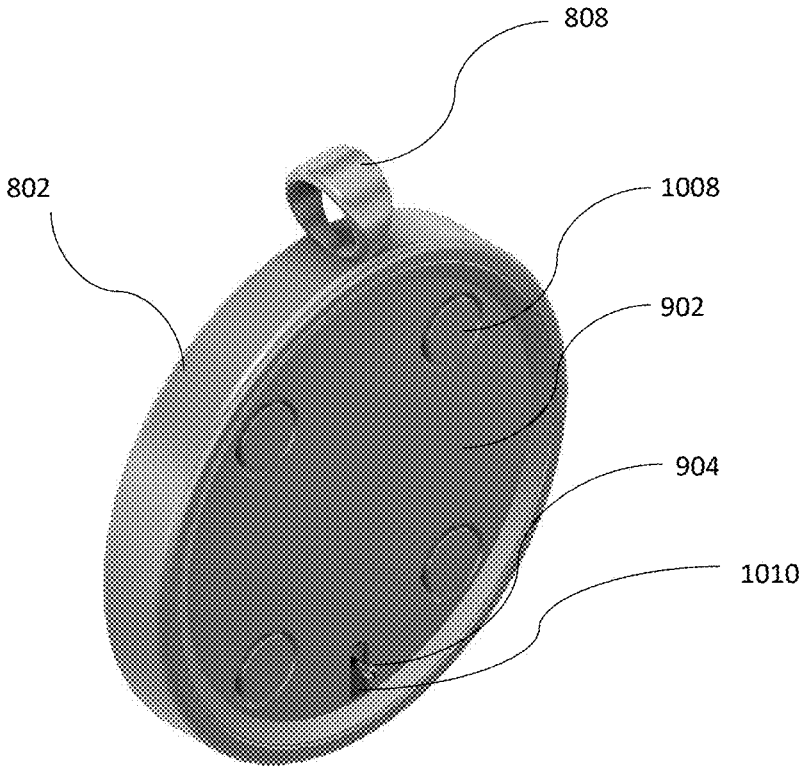
FIG. 13B illustrates another isometric view of the back plate cap encased within the back plate.

FIG. 13A, illustrates an isometric view of the back plate cap 902, according to another embodiment of the present disclosure. FIG. 13B, illustrates another isometric view of the back plate cap 902 encased within the back plate 802.

In some embodiments, the back plate cap 902 is configured to be encased within the back plate 802 to secure the spring reel 900 between the back plate 802 and the back plate cap 902. In some embodiments, the back plate cap 902 comprises the first set of attachment units 1008, as was shown in the FIG. 10 and now shown in the FIG. 13B. In some embodiments, the first set of attachment units 1008 corresponds to at least positive magnets. In some embodiments, the first set of attachment units 1008 may be integrated at the plurality of cavities 1006 fabricated at least one side 1300 of the back plate cap 902. In some embodiments, the at least one side 1300 of the back plate cap 902 may be facing opposite to the back plate 802 when the back plate cap 902 may be encased within the back plate 802.

In some embodiments, there may be other means of the first set of attachment units 1008 other than the at least positive magnets. The other means may include at least clasp arrangement, Velcro straps, adhesives etc. In some embodiments, the first set of attachment units 1008 may be integrated within the at least one side 1300 of the back plate cap 902 via one or more techniques. In some embodiments, the one or more techniques may include at least press fitting, adhesive bonding, over molding, mechanical interlocking, or magnetic embedding, depending on the structural and functional requirements of the first set of attachment units 1008. These techniques enable secure placement of the first set of attachment units 1008 while maintaining the overall integrity and compactness of the back plate cap 902.

In some embodiments, the back plate cap 902 may further comprise another side 1302. In some embodiments, the another side 1302 may be opposite to the at least one side 1300 of the back plate cap 902. In some embodiments, the another side 1302 of the back plate cap 902 may be an inner side of the breast-feeding necklace 800 and facing towards the back plate 802. In some embodiments, the back plate cap 902 may further comprise the second aperture 1010. In some embodiments, the second aperture 1010 may be configured to allow passing of the string 904 through the back plate cap 902 for attachment with the front plate 804. In some embodiments, the second aperture 1010 may be fabricated of various shapes and sizes.

Figure 15:
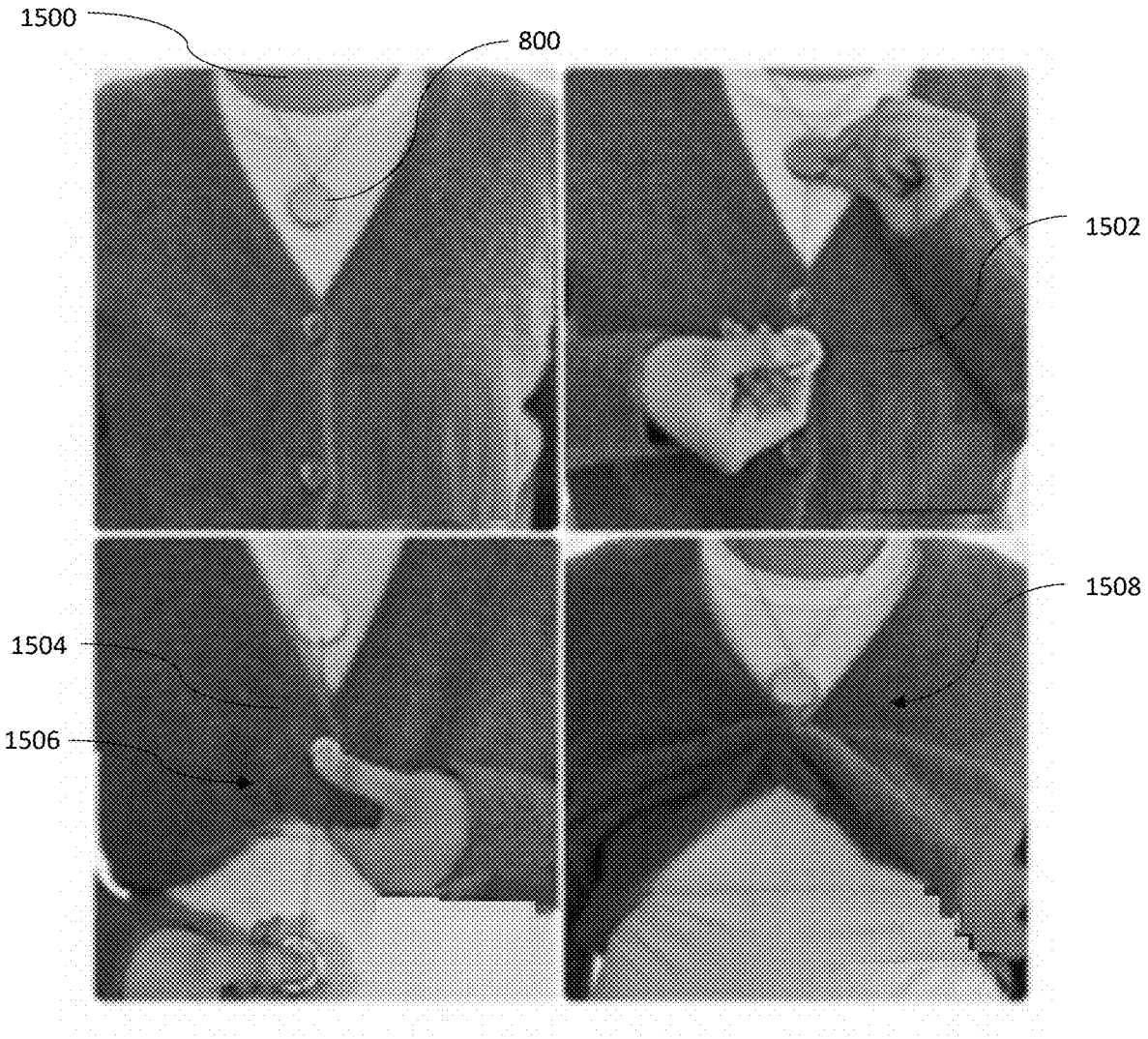
FIG. 15 illustrates an image representation of using the jewelry, according to an embodiment of the present disclosure.

FIG. 14, illustrates the breast-feeding necklace 800 with a chain 1400, according to another embodiment of the present disclosure. FIG. 15, illustrates an image representation of using the breast-feeding necklace 800, according to an embodiment of the present disclosure.

In some embodiments, the breast-feeding necklace 800 is configured for wearing by the user as an article of jewelry (e.g., pendant). The breast-feeding necklace 800 (or necklace) is configured to assist the user (i.e., lactating women) in holding up a layer of clothing to allow breast-feeding without the clothing getting in the way. In an aspect, the article of clothing may be a shirt, sweater, tank top, etc. comprising the upper layer of clothing being worn. It is contemplated by the Inventor that the article of clothing, once held will allow easy access to the breast by an infant improved posture, positioning and more visibility.

In some embodiments, the breast-feeding necklace 800 may be attached to the chain 1402 to allow the user to equip. Further, the chain 1400 may have a lock 1402 for locking the chain and wearing over neck, hand or other parts of a body of the user. In some embodiments, the lock 1402 may correspond to a lobster claw. In some embodiments, the chain 1400 may have one or more rings 1404 to adjust size of the chain 1400. In one example embodiment, as shown in the FIG. 15, the chain 1400 may be equipped around a neck 1500 of a user 1502.

In some embodiments, once equipped and the user 1502 wants to breast feed a child, the user 1502 may first detach the front plate 804 from the back plate 802/back plate cap 902. Further, after detaching the front plate 804, the user 1502 may stretch the front plate 804 such that the string 904 attached to the front plate 804 may be extended out from the spring reel 900. As the string 904 may be stretched, the user 1502 may extend the front plate 804 along with the string 904 from underneath a cloth 1504 as shown by 1506, and wrap the cloth 1504 using the string 904 as shown by 1508 in the FIG. 15. Further, once wrapping the cloth 1504, the user 1502 may reattach the front plate 804 to the back plate 802 or back plate cap 902 magnetically. In some embodiments, upon attaching the front plate 804, the cloth 1504 may be fixed in a position that may enable the user 1502 to breast feed the child easily.

Figure 16:
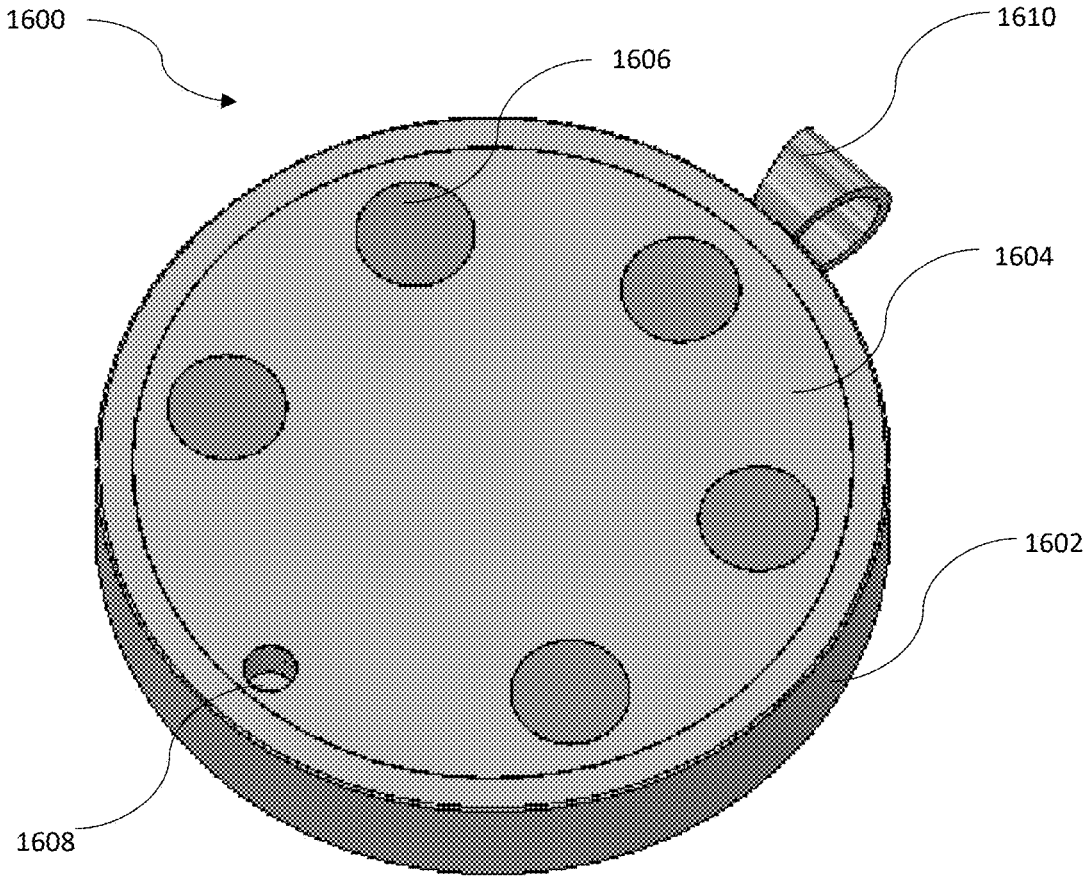
FIG. 16 illustrates an isometric view of a jewelry having a back plate and back plate cap, according to another embodiment of the present disclosure.
Figure 17:
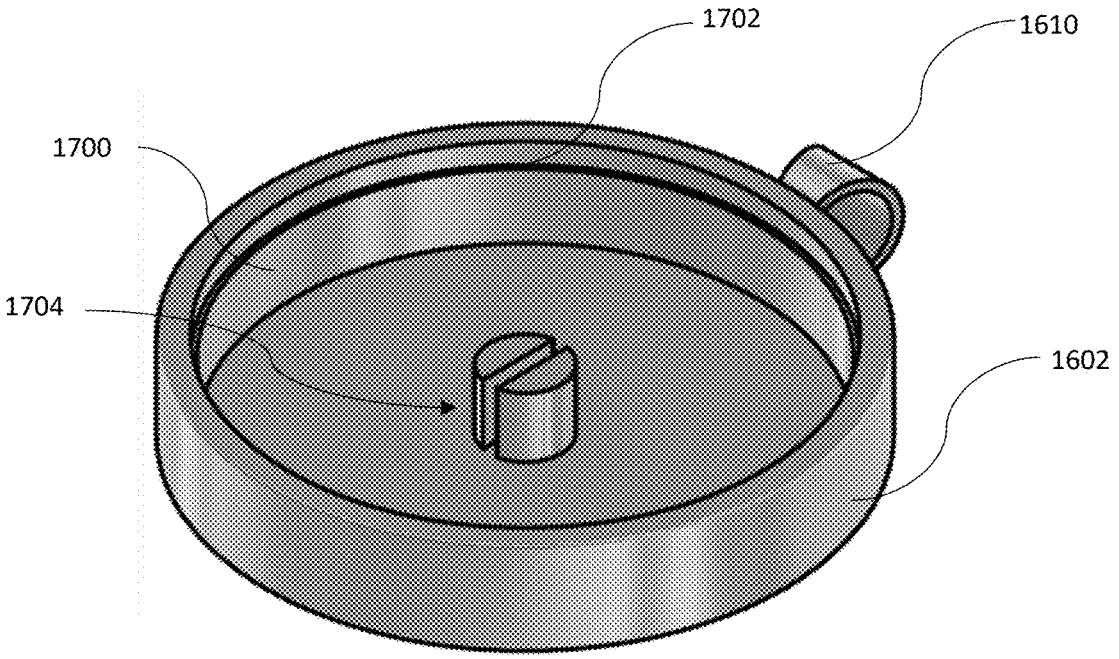
FIG. 17 illustrates a perspective of the back plate, according to another embodiment of the present disclosure.
Figure 18:
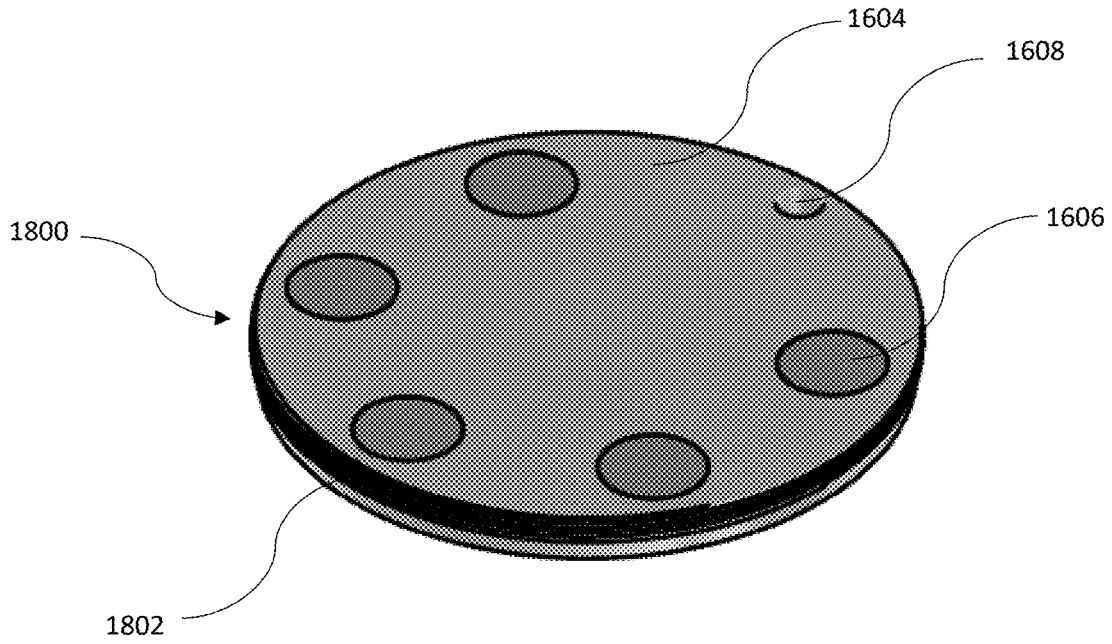
FIG. 18 illustrates a perspective view of the back plate cap, according to another embodiment of the present disclosure.
Figure 19:
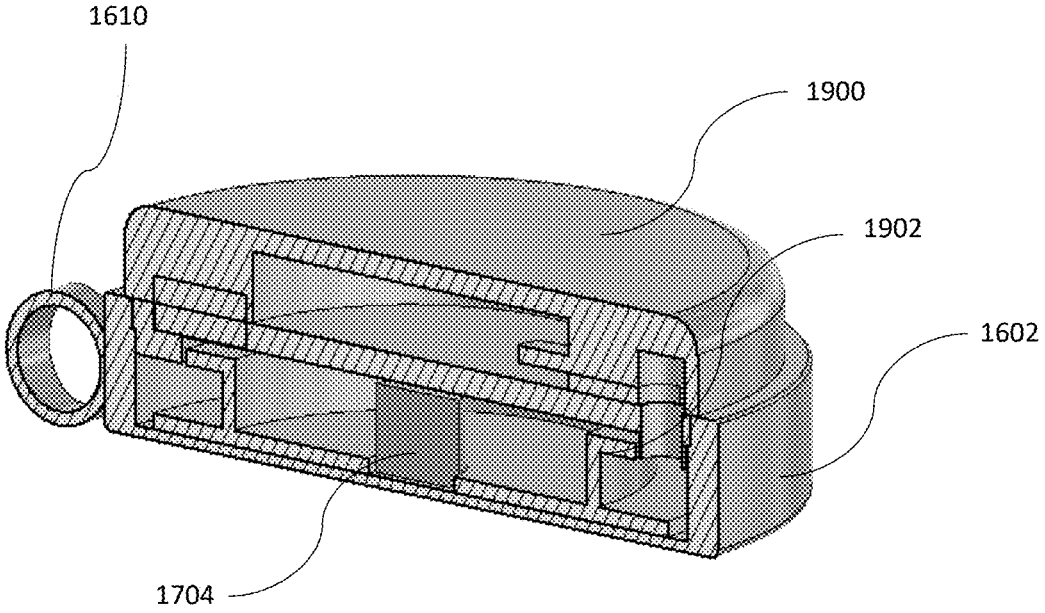
FIG. 19 illustrates a sectional view of the jewelry, according to another embodiment of the present disclosure.
Figure 20:
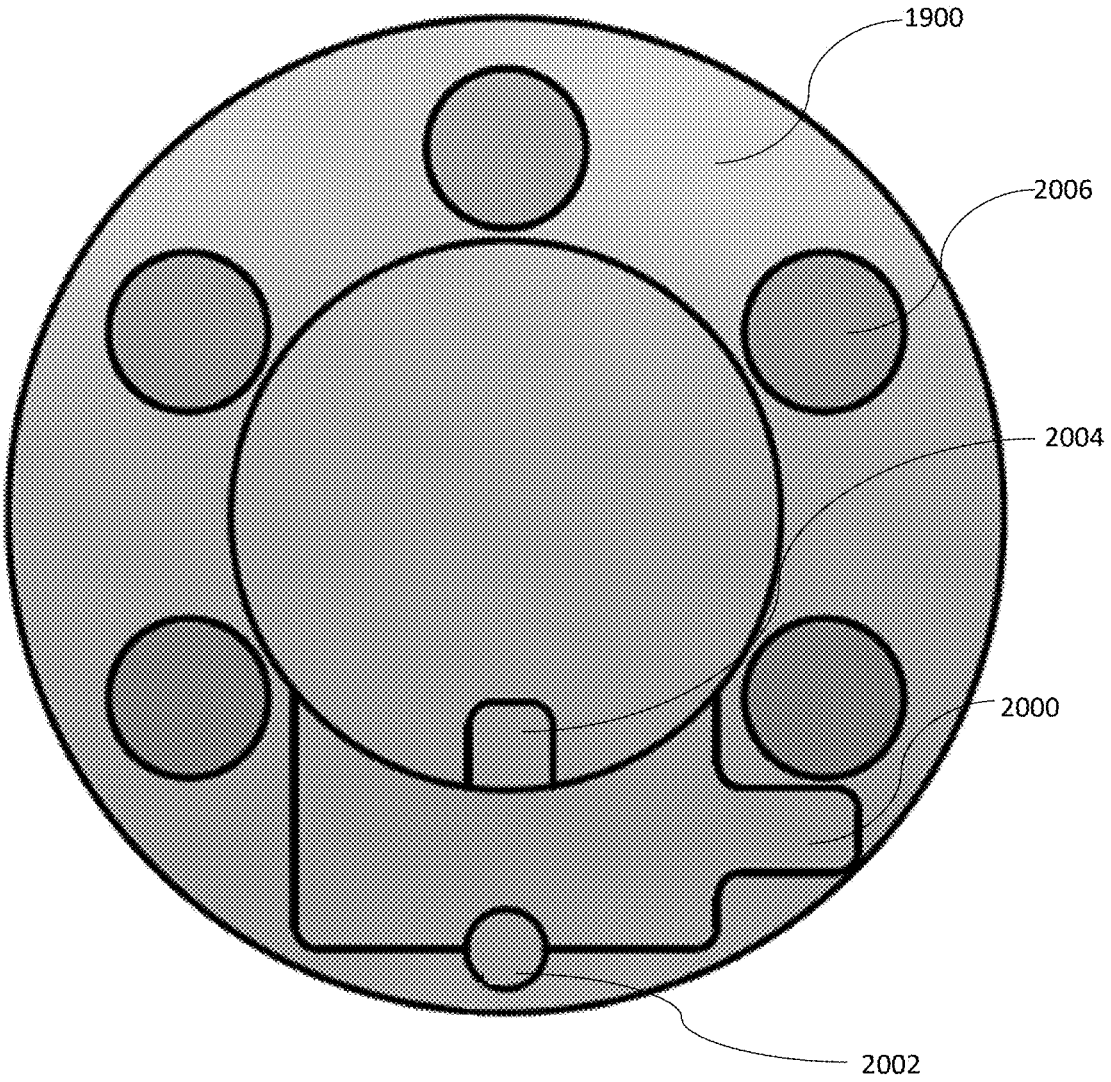
FIG. 20 illustrates a back view of a front plate, according to another embodiment of the present disclosure.

FIG. 16, illustrates an isometric view of a breast-feeding necklace 1600 having a back plate 1602 and back plate cap 1604, according to another embodiment of the present disclosure. FIG. 17, illustrates a perspective of the back plate 1602, according to another embodiment of the present disclosure. FIG. 18, illustrates a perspective view of the back plate cap 1604, according to another embodiment of the present disclosure. FIG. 19, illustrates a sectional view of the breast-feeding necklace 1600, according to another embodiment of the present disclosure. FIG. 20, illustrates a back view of a front plate 1900, according to another embodiment of the present disclosure.

In some embodiments, the breast-feeding necklace 1600 is configured for wearing by the user as an article of jewelry (e.g., pendant). The breast-feeding necklace 1600 (or necklace) is configured to assist the user (i.e., lactating women) in holding up a layer of clothing to allow breast-feeding without the clothing getting in the way. In an aspect, the article of clothing may be a shirt, sweater, tank top, etc. comprising the upper layer of clothing being worn. It is contemplated by the Inventor that the article of clothing, once held will allow easy access to the breast by an infant improved posture, positioning and more visibility.

In some embodiments, the breast-feeding necklace 1600 may comprise a back plate 1602 similar to the back plate 802 discussed earlier, a spring reel 1902 similar to the spring reel 900 discussed earlier, and the back plate cap 1604 similar to the back plate cap 904 discussed earlier. In some embodiments, the back plate cap 1604 may be configured to have a first set of attachments 1606 similar to the first set of attachments 1008. In some embodiments, the first set of attachments 1606 may correspond to at least positive magnets. The at least positive magnets may be of varied numbers and sizes. In one example, the at least positive magnets may be 5 as shown in the FIG. 16. Further, the back plate cap 1604 may comprise a second aperture 1608 similar to the second aperture 1010 and a ring bail 1610.

In some embodiments, an inner periphery 1700 of the back plate 1602 may include a first thread 1702 and a pinion lock 1704 similar to the pinion lock 1000. Further, an outer periphery 1800 of the back plate cap 1604 may include a second thread 1802. In some embodiments, the back plate cap 1604 may be detachably secured to the back plate 1602 via threaded engagement between the first thread 1702 and the second thread 1802. In some embodiments, the threaded engagement between the first thread 1702 and the second thread 1802 may allow the user to access the spring reel for regular maintenance of the breast-feeding necklace 1600.

Further, as shown in the FIG. 19, the spring reel and the back plate cap 1604 may be pressure fit and caster welded with the back plate 1602. Further, the back plate cap 1604 may comprise a gomit to hold a string in place. In some embodiments, the gomit is pressure fit and laser welded into place with the back plate cap 1604. Further, the first set of magnets may be glued with the back plate cap 1604. Further, a second set of magnets or second set of attachment units 2006 may be glued to a front plate 1900.

In some embodiments, the front plate 1900 may be detachably attached to one end of the string 904. In some embodiment, the front plate 1900 may have a second aperture towards the first side of the front plate. The second aperture may be configured to detachably attach the one end of the string. Further, the front plate comprise a second set of attachment units 2006. In some embodiments, the second set of attachment units 2006 corresponds to at least negative magnets. The at least negative magnets may be configured to magnetically engage with the positive magnets to detachably attach the front plate 1900 to the back plate cap 1604.

In some embodiments, the second set of attachment units 2006 may be integrated within the back plate cap 1604 via one or more techniques. In some embodiments, the one or more techniques may include at least press fitting, adhesive bonding, over molding, mechanical interlocking, or magnetic embedding, depending on the structural and functional requirements of the second set of attachment units 2006. These techniques enable secure placement of the second set of attachment units 2006 while maintaining the overall integrity and compactness of the front plate 1900.

In some embodiments, the front plate 1900 further comprises at least one cam lock 2000 and a slot 2002. In some embodiments, the at least one cam lock 2000 having a push button 2004. In some embodiments, the one end of the string 904 is interlocked within the slot 2002 and the push button 2004 is configured to release and detach the string from the front plate.

Figure 21:
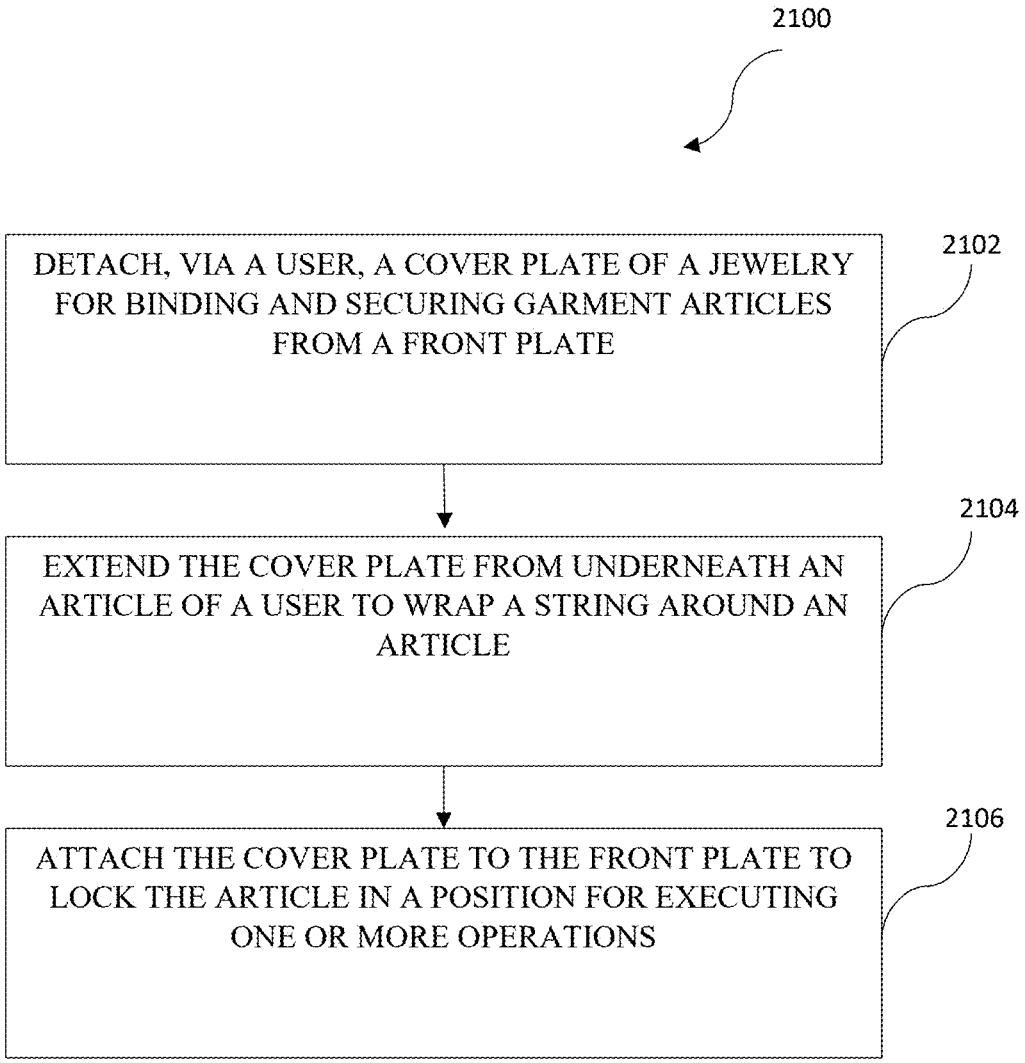
FIG. 21 illustrates a flowchart showing a method for the jewelry, according to another embodiment of the present disclosure.

FIG. 21, illustrates a flowchart showing a method 2100 for the breast-feeding necklace 800, according to another embodiment of the present disclosure.

At step 2102, the detaching, via a user, the front plate 804 of a jewelry for binding and securing garment articles i.e. breast-feeding necklace 800 from a back plate cap 902. In some embodiments, the breast-feeding necklace 800 comprises the back plate 802 and the front plate 804. In some embodiments, one side of the back plate 802 may be positioned along the surface of the user's cloth or body and an opposite side of the back plate 802 may be covered with the front plate 804. In some embodiments, the breast-feeding necklace 800 further comprises the spring reel 900, the back plate cap 902 and the front plate 804, as shown in the FIGS. 9 and 10. In some embodiments, the spring reel 900 further comprises the string 904 and the spring 906 as shown in the FIGS. 9 and 10.

Further, at step 2104, extending the front plate from underneath an article of the user to wrap the string around the article. Further, after detaching the front plate 804, the user 1502 may stretch the front plate 804 such that the string 904 attached to the front plate 804 may be extended out from the spring reel 900. As the string 904 may be stretched, the user 1502 may extend the front plate 804 along with the string 904 from underneath a cloth 1504 as shown by 1506, and wrap the cloth 1504 using the string 904 as shown by 1508 in the FIG. 15.

Further, at step 2106, attaching the front plate to the back plate cap to lock the article in a position for executing one or more operations such as breast-feeding etc. Further, once wrapping the cloth 1504, the user 1502 may attach back the front plate 804 back to the back plate 802 magnetically. In some embodiments, upon attaching the front plate 804, the cloth 1504 may be fixed in a position that may enable the user 1502 to breast feed the child easily.

The breast-feeding necklace 800 offers several advantages through its modular and wearable design. The back plate 802 with a monolithically attached pinion lock 1000 allows secure yet detachable fixation of the spring reel 900, improving maintainability. The combination of the string 904 and the spring 906 within the spring reel 900 enables smooth retraction and extension. The use of the back plate cap 902 and the front plate 804 with positive and negative magnets allows for quick and reliable coupling.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. For example, external plates, such as the pendant front and back plates may be connected to internal securing plates (e.g., back plate cap and back plate caps) in various ways not explicitly described. Additionally, elements as shown in the drawings, though not specifically mentioned in the present disclosure still comprise elements of the invention.

LIST OF ELEMENTS

Title: Jewelry for Binding and Securing Garment Articles

100 Jewelry for binding and securing garment articles (i.e., Breast-feeding necklace)
102 Pendant bail
104 Necklace chain (Side A)
106 Necklace chain (Side B)
108 Back plate
110 Front plate
112 Locking round clasp
114 Magnet slot
700 Jewelry for binding and securing garment articles (i.e., Breast-feeding necklace)
702 Back plate
704 Reel
706 Front plate cap
708 Back plate cap
710 Screws
712 Pendant front plate
714 Spring
716 String
718 Magnet
720 Slot, channel
800 Jewelry for binding and securing garment articles (i.e., Breast-feeding necklace)
802 Back plate
804 Front plate
806 Second surface portion
808 Ring bail
900 Spring reel
902 Back plate cap
904 String
906 Spring
1000 Pinion lock
1002 First surface portion
1004 Cover
1006 Plurality of cavities
1008 First set of attachment units
1010 Second aperture
1100 Pair of protruded sections
1102 Narrow gap
1200 Central flat portion
1202 Perpendicularly extended portion
1204 Outer periphery
1206 Hole
1208 First aperture
1210 Flat portion
1300 At least one side
1302 Another side
1500 Neck
1502 User
1504 Cloth
1506 Arrow
1508 Arrow
1600 Jewelry for binding and securing garment articles (i.e., Breast-feeding necklace)
1602 Back plate
1604 Back plate cap
1606 First set of attachments

1608 Second aperture
1610 Ring bail
1700 Inner periphery
1702 First thread
1704 Pinion lock
1800 Outer periphery
1802 Second thread
1900 Front plate
1902 Spring reel
2000 At least one cam lock
2002 Slot
2004 Push button
2006 Second set of attachment units
2100 Flowchart
2102 Step
2104 Step
2106 Step

What is claimed is:

1. A jewelry for binding and securing garment articles comprising:

a back plate comprising:

a pinion lock monolithically attached over a first surface portion of the back plate;

a spring reel encased within the back plate and detachably affixed to the pinion lock, the spring reel comprising:

a string coiled around an outer periphery of the spring reel; and a spring coiled within an inner periphery of the spring reel; and a back plate cap encased within the back plate to secure the spring reel between the back plate and the back plate cap, wherein the back plate cap comprising a first set of attachment units; and a front plate detachably attached at one end of the string, the front plate comprising a second set of attachment units, wherein the front plate is configured to detachably engage with the back plate cap via the first set of attachment units and the second set of attachment units.

2. The jewelry for binding and securing garment articles of claim 1, wherein an inner periphery of the back plate includes a first thread, and wherein an outer periphery of the back plate cap includes a second thread, such that the back plate cap is detachably secured to the back plate via a threaded engagement between the first thread and the second thread.

3. The jewelry for binding and securing garment articles of claim 1, wherein the first set of attachment units corresponds to at least positive magnets; and wherein the second set of attachment units corresponds to at least negative magnets configured to magnetically engage with the positive magnets.

4. The jewelry for binding and securing garment articles of claim 1, wherein an opposite end of the string is having a knot and the spring reel is having a first aperture, wherein the knot is configured to pass through the first aperture to secure the opposite end of the string to the spring reel.

5. The jewelry for binding and securing garment articles of claim 1, wherein the back plate cap further comprises a second aperture, wherein the second aperture is configured to allow passing of the string through the back plate cap for attachment with the front plate.

6. The jewelry for binding and securing garment articles of claim 1, wherein the back plate further comprises a ring bail monolithically attached to a second surface portion of the back plate, wherein the ring bail is configured to receive a chain for enabling a user to wear the jewelry.

7. The jewelry for binding and securing garment articles of claim 1, wherein the spring reel further comprises an extruded cut, wherein one end of the spring incudes a bend, wherein the bend is affixed within the extruded cut to retain the spring in a loaded position within the spring reel.

8. The jewelry for binding and securing garment articles of claim 1, wherein the spring reel further comprises a cover that is positioned over the spring reel to secure the spring within the spring reel, the cover corresponds to a Teflon paper.

9. The jewelry for binding and securing garment articles of claim 1, wherein the front plate further comprises at least one cam lock and a slot, wherein the at least one cam lock having a push button.

10. The jewelry for binding and securing garment articles of claim 9, wherein the one end of the string is interlocked within the slot and the push button is configured to release and detach the string from the front plate.

11. A method comprising:

detaching, via a user, a front plate of a jewelry for binding and securing garment articles from a back plate cap, wherein the jewelry comprising:

a back plate comprising:

a pinion lock monolithically attached over a first surface portion of the back plate;

a spring reel encased within the back plate and detachably affixed to the pinion lock, the spring reel comprising:

a string coiled around an outer periphery of the spring reel; and a spring coiled within an inner periphery of the spring reel; and the back plate cap encased within the back plate to secure the spring reel between the back plate and the back plate cap, wherein the back plate cap comprising a first set of attachment units; and the front plate detachably attached to one end of the string, the front plate comprising a second set of attachment units, wherein the front plate is configured to detachably engage with the back plate cap via the first set of attachment units and the second set of attachment units;

extending the front plate from underneath an article of the user to wrap the string around the article; and attaching the front plate to the back plate cap to lock the article in a position for executing one or more operations.

12. The method of claim 11, wherein an inner periphery of the back plate includes a first thread, and wherein an outer periphery of the back plate cap includes a second thread, such that the back plate cap is detachably secured to the back plate via a threaded engagement between the first thread and the second thread.

13. The method of claim 11, wherein the first set of attachment units corresponds to at least positive magnets; and wherein the second set of attachment units corresponds to at least negative magnets configured to magnetically engage with the positive magnets.

14. The method of claim 11, wherein an opposite end of the string is having a knot and the spring reel is having a first aperture, wherein the knot is configured to pass through the first aperture to secure the opposite end of the string to the spring reel.

15. The method of claim 11, wherein the back plate cap further comprises a second aperture, wherein the second aperture is configured to allow passing of the string through the back plate cap for attachment with the front plate.

16. The method of claim 11, wherein the back plate further comprises a ring bail monolithically attached to a second surface portion of the back plate, wherein the ring bail is configured to receive a chain for enabling a user to wear the jewelry.

17. The method of claim 11, wherein the spring reel further comprises an extruded cut, wherein one end of the spring incudes a bend, wherein the bend is affixed within the extruded cut to retain the spring in a loaded position within the spring reel.

18. The method of claim 11, wherein the spring reel further comprises a cover that is positioned over the spring reel to secure the spring within the spring reel, the cover corresponds to a Teflon paper.

19. The method of claim 11, wherein the front plate further comprises at least one cam lock and a slot, wherein the at least one cam lock having a push button.

20. The method of claim 19, wherein the one end of the string is interlocked within the slot and the push button is configured to release and detach the string from the front plate.

* * * * *